United States Patent [19]

Bridges et al.

[11] Patent Number: 4,645,004

[45] **Date of Patent: * Feb. 24, 1987**

[54] ELECTRO-OSMOTIC PRODUCTION OF HYDROCARBONS UTILIZING CONDUCTION HEATING OF HYDROCARBONACEOUS FORMATIONS

[75] Inventors: Jack E. Bridges, Park Ridge; Allen Taflove, Wilmette; Guggilam C. Sresty, Burbank, all of Ill.

[73] Assignee: IIT Research Institute, Chicago, Ill.

[ * ] Notice: The portion of the term of this patent subsequent to Oct. 8, 2002 has been disclaimed.

[21] Appl. No.: 603,583

[22] Filed: Apr. 25, 1984

Related U.S. Application Data

[63] Continuation-in-part of Ser. No. 489,746, Apr. 29, 1983, abandoned.

[51] Int. Cl.[4] ..... E21B 43/24

[52] U.S. Cl. ..... 166/248; 166/65.1

[58] Field of Search ..... 166/248, 272, 60, 65.1, 166/245

[56] References Cited

U.S. PATENT DOCUMENTS

| | | | |
|---|---|---|---|
| Re. 30,738 | 9/1981 | Bridges et al. | 166/248 |
| 2,732,195 | 1/1947 | Ljungstrom . | |
| 2,795,279 | 6/1957 | Sarapuu . | |
| 2,799,641 | 7/1957 | Bell | 204/180 |
| 2,801,090 | 7/1957 | Hoyer et al. . | |
| 3,137,347 | 6/1964 | Parker . | |
| 3,428,125 | 2/1969 | Parker | 166/248 |
| 3,507,330 | 4/1970 | Gill | 166/248 |
| 3,547,193 | 12/1970 | Gill | 166/248 |

List Continued on next page.

OTHER PUBLICATIONS

Flock, Donald L. et al., "Unconventional Methods of Recovery of Bitumen and Related Research Areas Particular to the Oil Sands of Alberta," Journal of Canadian Petroleum Technology, Jul.-Sep., 1975, Montreal, pp. 17-20.

Harvey, A. Herbert, et al., "Selective Reservoir Heating Could Boost Oil Recovery," Oil & Gas Journal, Nov. 13, 1978, pp. 185-190.

Vermeulen, et al., "Physical Modelling of the Electromagnetic Heating of Oil Sand and Other Earth-Type and Biological Materials", Can. Elec. Eng. J., vol. 4, No. 4, 1979, pp. 19-28.

*Primary Examiner*—George A. Suchfield
*Assistant Examiner*—Bruce M. Kisliuk
*Attorney, Agent, or Firm*—Fitch, Even, Tabin & Flannery

[57] ABSTRACT

An electro-osmotic method for the production of hydrocarbons utilizes in situ heating of earth formations having substantial electrical conductivity. A particular volume of an earth formation is bounded with a waveguide structure formed of respective rows of discrete elongated electrodes in a dense array wherein the active electrode area and the row separation are chosen in reference to the deposit thickness to avoid heating barren layers. Electrical power is applied at no more than a relatively low frequency between respective rows of electrodes to deliver power to the formation while producing relatively uniform heating thereof and limiting the relative loss of heat to adjacent regions to less than a predetermined amount. At the same time the temperature of the electrodes is controlled near the vaporization point of water to maintain an electrically conductive path between the electrodes and the formation. A heat sink is provided by supplying aqueous liquid electrolyte to space between the electrodes and the adjacent formation, thereby maintaining the temperature thereat no greater than about the boiling point of water and maintaining a conductive path between said formation. A d.c. polarized potential is applied to enhance flow of reservoir fluid into a preselected row of electrodes, and collected reservoir fluids are removed from the electrodes in the preselected row.

15 Claims, 13 Drawing Figures

U.S. PATENT DOCUMENTS

| | | | |
|---|---|---|---|
| 3,605,888 | 9/1971 | Crowson et al. | 166/248 |
| 3,620,300 | 11/1971 | Crowson | 166/248 |
| 3,642,066 | 2/1972 | Gill | 166/248 |
| 3,724,543 | 4/1973 | Bell et al. | 166/248 |
| 3,782,465 | 1/1974 | Bell et al. | 166/248 |
| 3,848,671 | 11/1974 | Kern | 166/248 |
| 3,862,662 | 1/1975 | Kern | 166/248 |
| 3,874,450 | 4/1975 | Kern | 166/248 |
| 3,878,312 | 4/1975 | Bergh et al. | 174/9 F |
| 3,946,809 | 3/1976 | Hagedorn | 166/248 |
| 3,948,319 | 4/1976 | Pritchett | 166/248 |
| 3,958,636 | 5/1976 | Perkins | 166/248 |
| 4,010,799 | 3/1977 | Kern et al. | 166/248 |
| 4,013,538 | 3/1977 | Schneider et al. | 204/280 |
| 4,084,637 | 4/1978 | Todd | 166/245 |
| 4,334,580 | 6/1982 | Vann | 166/268 |
| 4,382,469 | 5/1983 | Bell et al. | 166/248 |
| 4,386,665 | 6/1983 | Dellinger | 175/61 |
| 4,489,782 | 12/1984 | Perkins | 166/248 |
| 4,545,435 | 10/1985 | Bridges et al. | 166/60 |

Fig. 9.
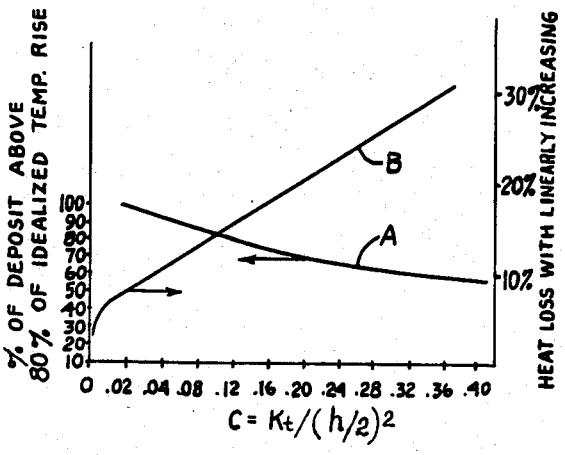
Fig. 10.
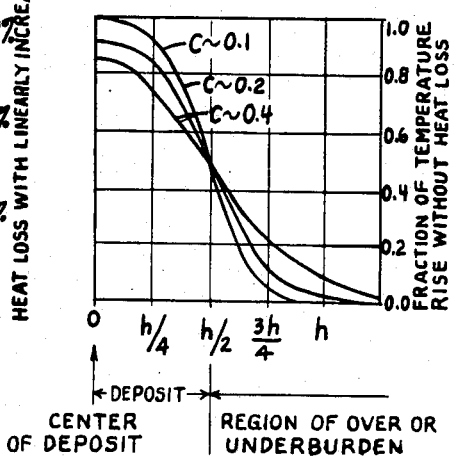
Fig. 11.
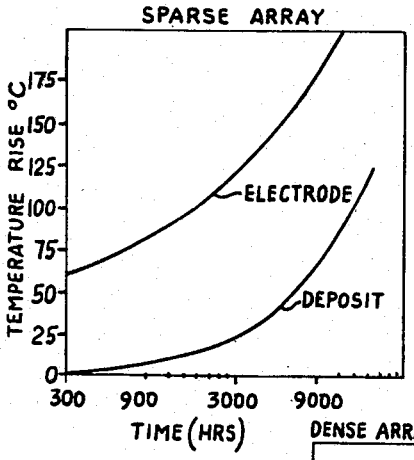
Fig. 12.
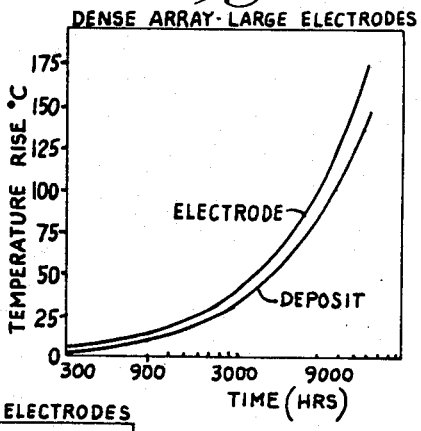
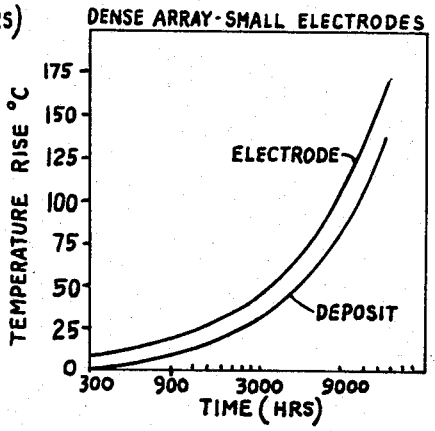
Fig. 13.

ELECTRO-OSMOTIC PRODUCTION OF HYDROCARBONS UTILIZING CONDUCTION HEATING OF HYDROCARBONACEOUS FORMATIONS

This application is a continuation in part of U.S. application Ser. No. 489,746, filed Apr. 29, 1983, now abandoned.

BACKGROUND OF THE INVENTION

This invention relates generally to the exploitation of hydrocarbon-bearing formations having substantial electrical conductivity, such as tar sands and heavy oil deposits, by the application of electrical energy to heat the deposits. More specifically, the invention relates to the delivery of electrical power to a conductive formation at relatively low frequency or d.c., which power is applied between rows of elongated electrodes forming a waveguide structure bounding a particular volume of the formation, while at the same time the temperature of the electrodes is controlled.

Materials such as tar sands and heavy oil deposits are amenable to heat processing to produce gases and hydrocarbons. Generally the heat develops the porosity, permeability and/or mobility necessary for recovery. Some hydrocarbonaceous materials may be recovered upon pyrolysis or distillation, others simply upon heating to increase mobility.

Materials such as tar sands and heavy oil deposits are heterogeneous dielectrics. Such dielectric media exhibit very large values of conductivity, relative dielectric constant, and loss tangents at low temperature, but at high temperatures exhibit lower values for these parameters. Such behavior arises because in such media ionic conducting paths or layers are established in the moisture contained in the interstitial spaces in the porous, relatively low dielectric constant and loss tangent rock matrix. Upon heating, the moisture evaporates, which radically reduces the bulk conductivity, relative dielectric constant, and loss tangent to essentially that of the rock matrix.

It has been known to heat electrically relatively large volumes of hydrocarbonaceous formations in situ. Bridges and Taflove U.S. Pat. No. Re. 30,738 discloses a system and method for such in situ heat processing of hydrocarbonaceous earth formations wherein a plurality of elongated electrodes are inserted in formations and bound a particular volume of a formation of interest. As used therein, the term "bounding a particular formation" means that the volume is enclosed on at least two sides thereof. The enclosed sides are enclosed in an electrical sense with a row of discrete electrodes forming a particular side. Electrical excitation between rows of such electrodes established electrical fields in the volume. As disclosed in such patent, the frequency of the excitation was selected as a function of the bounded volume so as to establish a substantially nonradiating electric field which was confined substantially in the volume. The method and system of the reissue patent have particular application in the radio-frequency heating of moderately lossy dielectric formations at relatively high frequency. However, it is also useful in relatively lossy dielectric formations where relatively low frequency electrical power is utilized for heating largely by conduction. The present invention is directed toward the improvement of such method and system for such heating of relatively conductive formations at relatively low frequency and to the application of such system for heating with d.c.

SUMMARY OF THE INVENTION

For electrically heating conductive formations, it is desirable to utilize relatively low frequency electrical power or d.c. to achieve relatively uniform heating distribution along the line. At low frequency, it is necessary that conductive paths remain conductive between the subsurface electrodes and the formation being heated. It is also desirable to heat the formation as fast as possible in order to minimize heat outflow to barren regions. This presents certain inconsistent requirements, as fast heating requires a large amount of heat at the electrodes, and the resultant high temperatures boil away the water needed to maintain the conductive paths. On the other hand, if the heating proceeds slowly, excessive temperatures leading to vaporization of water and consequent loss of conductivity are avoided, but there is economically wasteful loss of heat to the barren formations in the extended time needed to heat the deposit of interest.

It is a primary aspect of the present invention to provide compromises to best meet such disparate requirements in the in situ heating of earth formations having substantial conductivity. A waveguide structure as shown in the reissue patent is emplanted in the earth to bound a particular volume of an earth formation with a waveguide structure formed of respective rows of discrete elongated electrodes wherein the spacing between rows is greater than the distance between electrodes in a respective row and in the case of vertical electrodes substantially less than the thickness of the hydrocarbonaceous earth formation. Electrical power at no more than a relatively low frequency is applied between respective rows of the electrodes to deliver power to the formation while producing relatively uniform heating thereof and limiting the relative loss of heat to adjacent barren regions to less than a tolerable amount. At the same time the temperature of the electrodes is controlled near the vaporization point of water thereat to maintain an electrically conductive path between the electrodes and the formation. A d.c. polarized potential is applied to enhance flow of reservoir fluid toward at least one preselected electrode.

A waveguide electrical array which employs a limited number of small diameter electrodes would be less expensive to install than an array using more electrodes but would result in excess electrode temperature and nonuniform heating and consequently inefficient use of electrical power. On the other hand, a dense array, that is, one in which the spacing s between rows is greater than the distance d between electrodes in a row, would be somewhat more costly, but would heat more uniformly and more rapidly and, therefore, be more energy efficient.

A key to optimizing these conflicting factors is to control the temperature of the electrodes and the resource immediately adjacent the electrodes by properly selecting the deposit gas pressure, heating rates, heating time, final temperature, electrode geometry and positioning and/or cooling the electrodes.

These and other aspects and advantages of the present invention will become more apparent from the following detailed description, particularly when taken in conjunction with the accompanying drawings.

BRIEF DESCRIPTION OF THE DRAWINGS

FIG. 9 is a set of curves showing the relationship between a time dependent factor c and heat loss and a function of deposit temperature utilizing the present invention;

FIG. 10 is a set of curves showing the temperature distribution at different heating rates when heat is delivered to a defined volume;

FIG. 11 is a set of curves showing the relationship between time and temperature at different points when a formation is heated by a sparse array;

FIG. 12 is a set of curves showing the relationship between time and temperature at different points when a formation is heated in accordance with the present invention with electrode diameters of 32 inches; and FIG. 13 is a set of curves showing the relationship of time and temperature at the same points as in FIG. 12 in accordance with the present invention with electrode diameters of 14 inches.

DETAILED DESCRIPTIONS OF THE PREFERRED EMBODIMENTS

Figure 1:
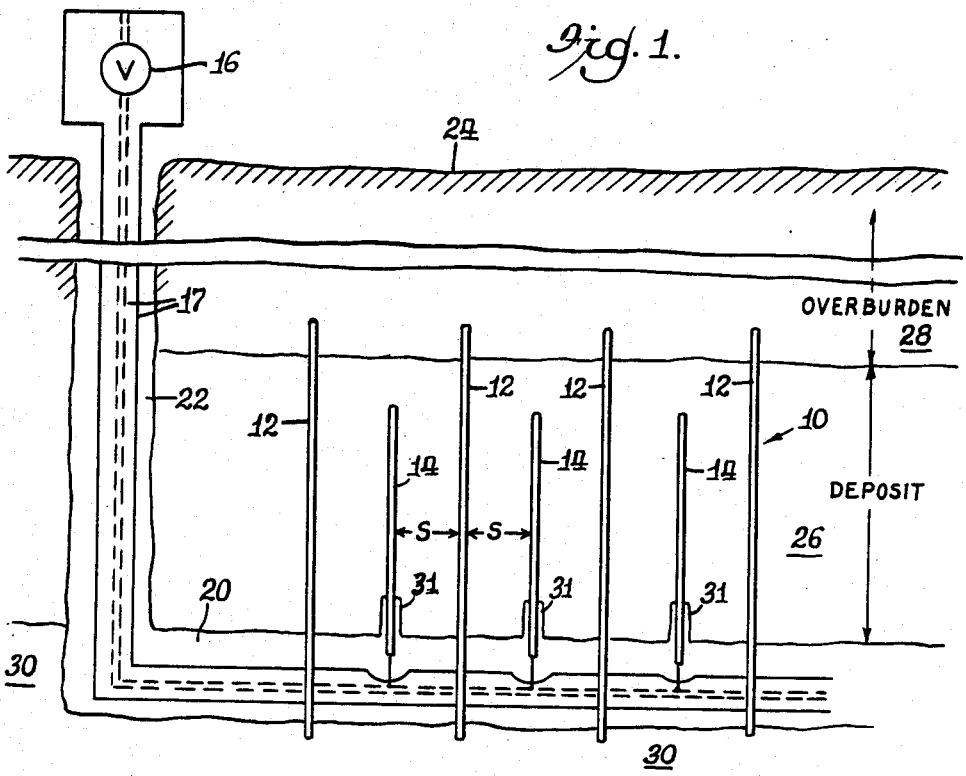
FIG. 1 is a vertical sectional view, partly diagrammatic, of a preferred embodiment of a system for the conductive heating of an earth formation in accordance with the present invention, wherein an array of electrodes is emplaced vertically, the section being taken transversely of the rows of electrodes.
Figure 2:
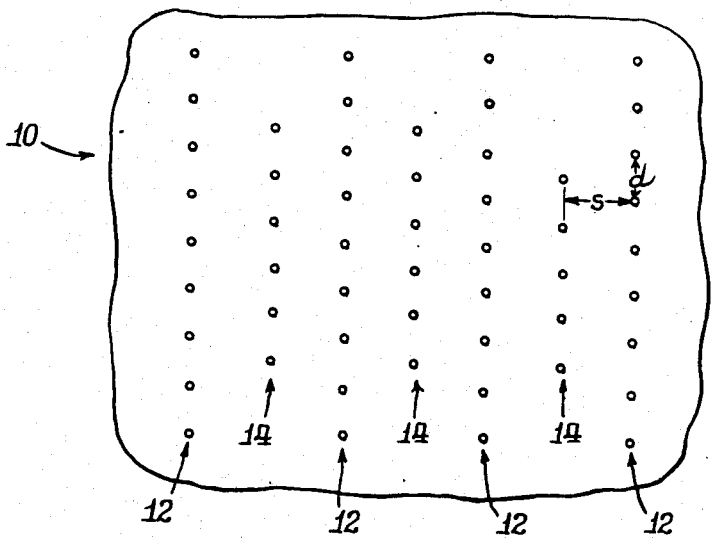
FIG. 2 is a diagrammatic plan view of the system shown in FIG. 1.
Figure 3:
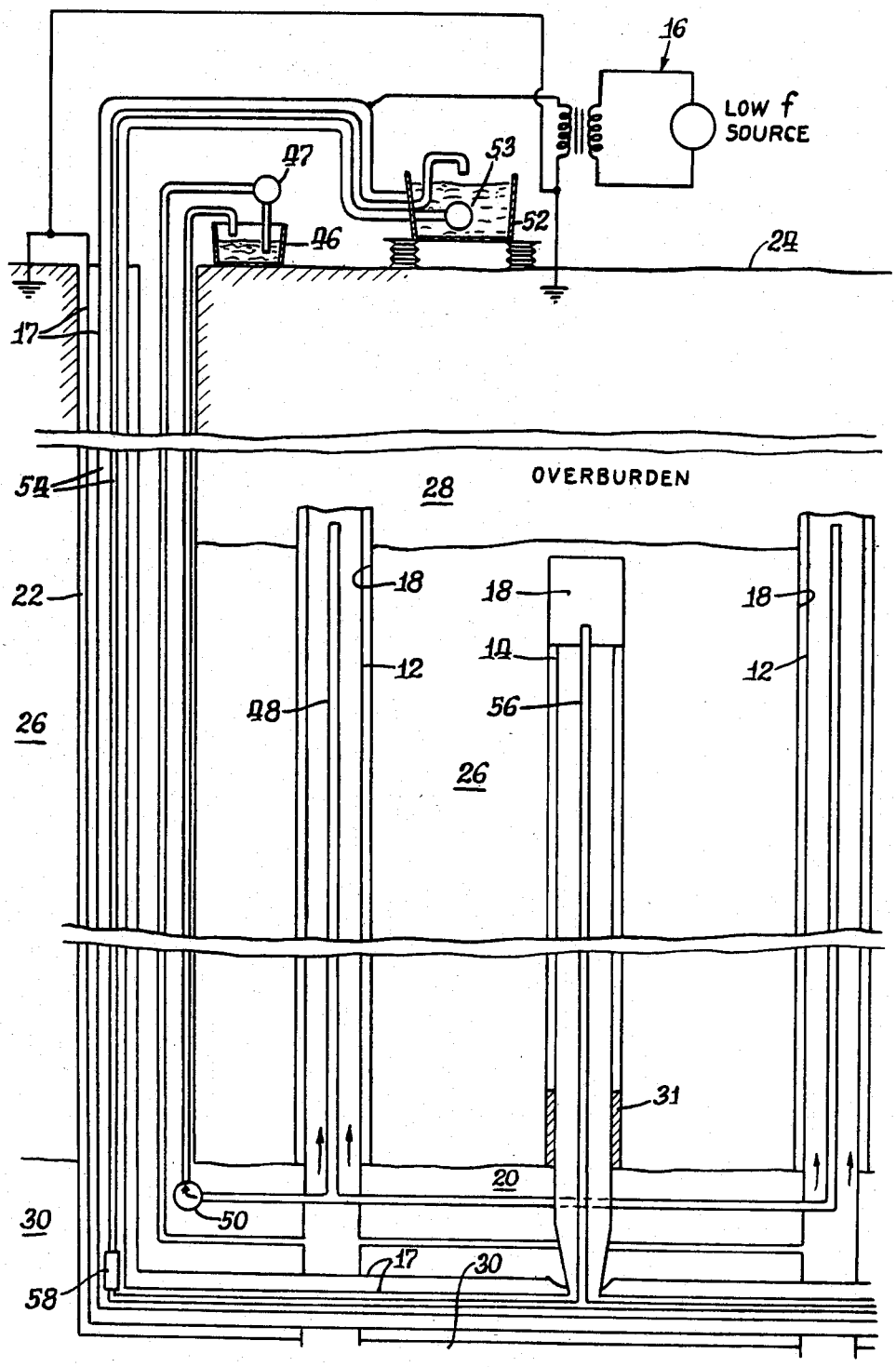
FIG. 3 is an enlarged vertical sectional view, partly diagrammatic, of part of the system shown in FIG. 1.

FIGS. 1, 2 and 3 illustrate a system for heating conductive formations utilizing an array 10 of vertical electrodes 12, 14, the electrodes 12 being grounded, and the electrodes 14 being energized by a low frequency or d.c. source 16 of electrical power by means of a coaxial line 17. The electrodes 12, 14 are disposed in respective parallel rows spaced a spacing s apart with the electrodes spaced apart a distance d in the respective rows. The electrode array 10 is a dense array, meaning that the spacing s between rows is greater than the distance d between electrodes in a row. The rows of electrodes 12 are longer than the rows of electrodes 14 to confine the electric fields and consequent heating at the ends of the rows of electrodes 14.

The electrodes 12, 14 are tubular electrodes emplaced in respective boreholes 18. The electrodes may be emplaced from a mined drift 20 accessed through a shaft 22 from the surface 24 of the earth. The electrodes 12 preferably extend, as shown, through a deposit 26 or earth formation containing the hydrocarbons to be produced. The electrodes 12 extend into the overburden 28 above the deposit 26 and into the underburden 30 below the deposit 26. The electrodes 14, on the other hand, are shorter than the electrodes 12 and extend only part way through the deposit 26, short of the overburden 28 and underburden 30. In order to avoid heating the underburden and to provide the power connection, the lower portions of the electrodes 14 may be insulated from the formations by insulators 31, which may be air. The effective lengths of the electrodes 14 therefore end at the insulators 31.

Figure 4:
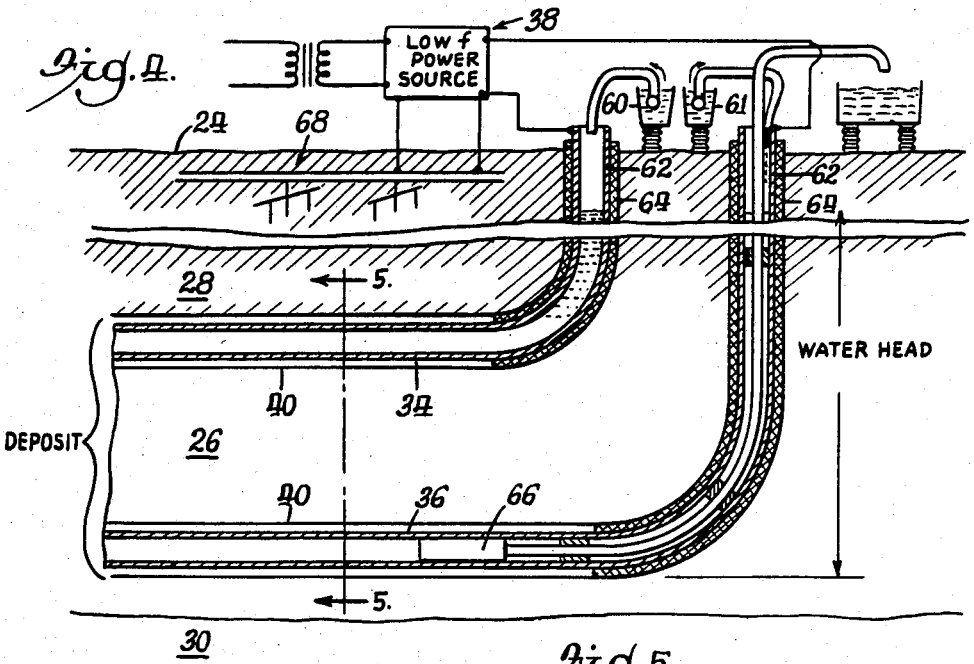
FIG. 4 is a vertical sectional view, partly diagrammatic, of an alternative system for the conductive heating of an earth formation in accordance with the present invention, wherein an array of electrodes is emplaced horizontally, the section being taken longitudinally of the electrodes.
Figure 5:
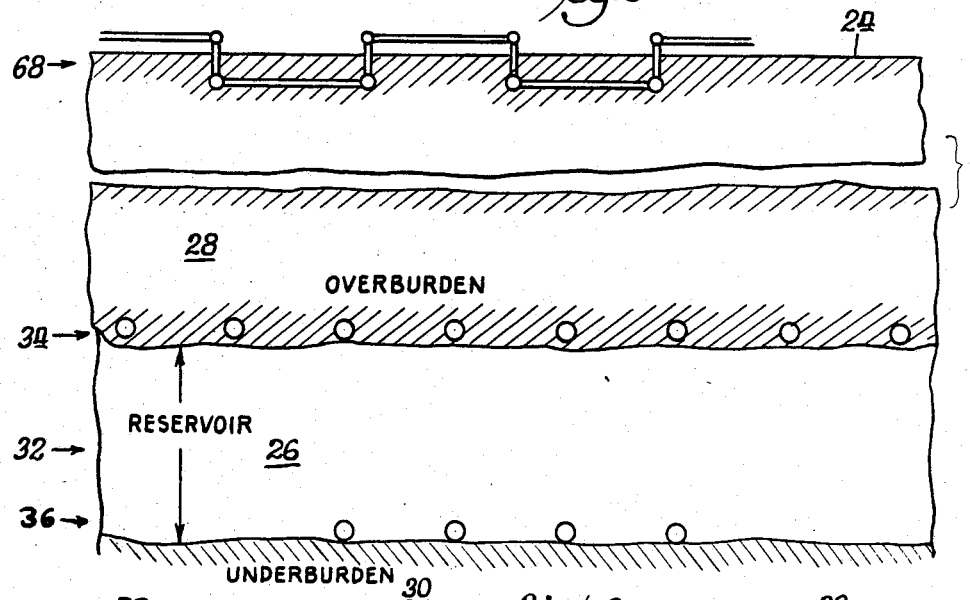
FIG. 5 is a vertical sectional view, partly diagrammatic of the system shown in FIG. 4, taken along line 5—5 of FIG. 4.

FIGS. 4 and 5 illustrate a system for heating conductive formations utilizing an array 32 of horizontal electrodes 34, 36 disposed in vertically spaced parallel rows, the electrodes 34 being in the upper row and the electrodes 36 in the lower row. The upper electrodes 34 are preferably grounded, and the lower electrodes 36 are energized by a low frequency or d.c. source 38 of electrical power. The electrodes 34, 36 are disposed in parallel rows spaced apart a spacing s, with the electrodes spaced apart a distance d in the respective rows. The electrode array 32 is also a dense array. The upper row of electrodes 34 is longer than the lower row of electrodes 36 to confine the electric fields from the electrodes 36. The electrodes 34 extend beyond both ends of the electrodes 36 for the same reason. Grounding the upper electrodes 34 keeps down stray fields at the surface 24 of the earth.

The electrodes 34, 36 are tubular electrodes emplaced in respective boreholes 40 which may be drilled by well known directional drilling techniques to provide horizontal boreholes at the top and bottom of the deposit 26 between the overburden 28 and the underburden 30. Preferably the upper boreholes are at the interface between the deposit 26 and the overburden 28, and the lower boreholes are slightly above the interface between the deposit 26 and the underburden 30.

Figure 6:
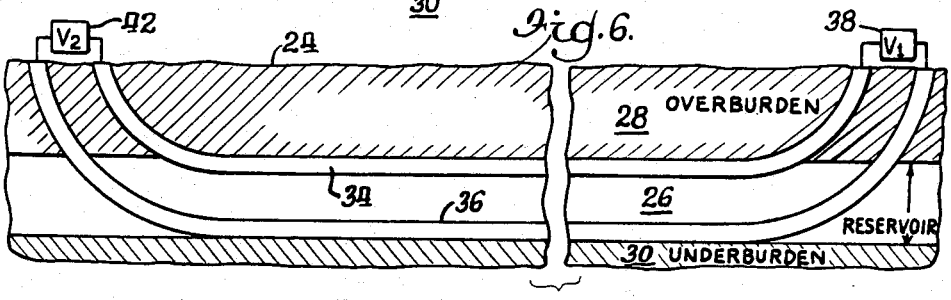
FIG. 6 is a vertical sectional view comparable to that of FIG. 4 showing an alternative system with horizontal electrodes fed from both ends.

FIG. 6 illustrates a system comparable to that shown in FIGS. 4 and 5 wherein the array is fed from both ends, a second power source 42 being connected at the end remote from the power source 38.

Figure 7:
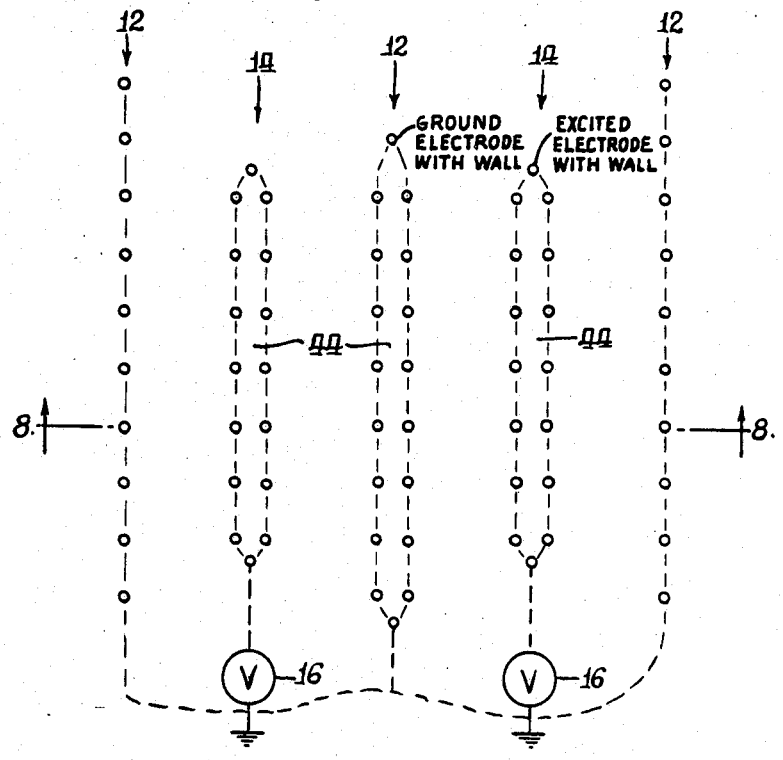
FIG. 7 is a plan view, mostly diagrammatic, of an alternative system comparable to that shown in FIG. 3, with cool walls adjacent electrodes.
Figure 8:
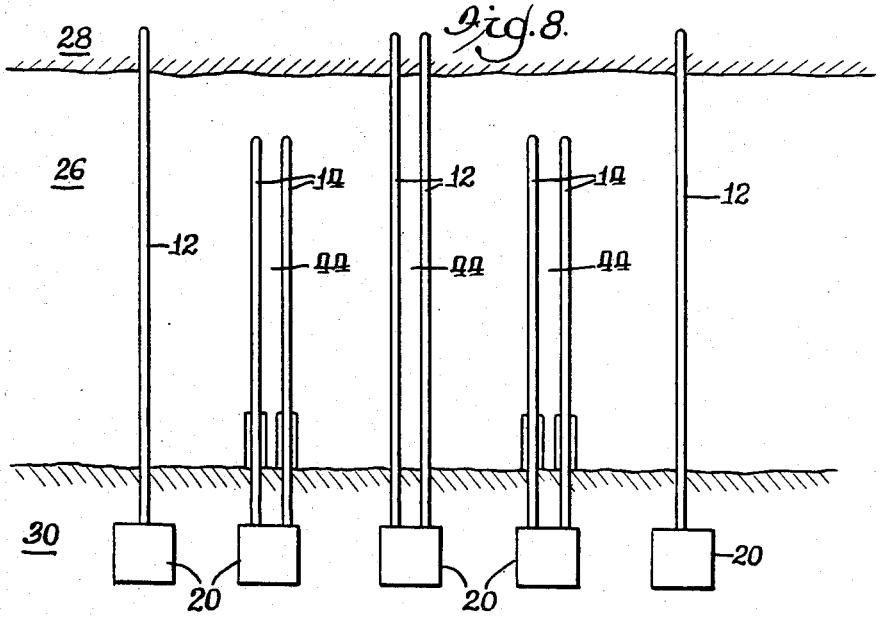
FIG. 8 is a vertical sectional view, partly diagrammatic of the system shown in FIG. 7, taken along line 8—8 of FIG. 7.

FIGS. 7 and 8 illustrate a system comparable to that of FIGS. 1, 2 and 3 with an array of vertical electrodes. In this system the rows of like electrodes 12, 14 are in spaced pairs to provide a low field region 44 therebetween that is not directly heated to any great extent.

The deposit thickness h and the average or effective thermal diffusion properties determine the uniformity of the temperature distribution as a function of heating time t and can be generally described for any thickness of a deposit in the terms of a deposit temperature profile factor c, such that $$c = kt/(h/2)^2$$

where k is the thermal diffusivity. FIG. 9 presents a curve A showing the relationship between the factor c and the portion of a deposit above 80% of the temperature rise of the center of the deposit for a uniform heating rate through the heated volume. Note that at $c=0.1$, about 75% of the heated volume has a temperature rise greater than 80% of the temperature rise of the center of the heated volume.

FIG. 10 illustrates the heating profiles for three values of the factor c as a function of the distance from the center of the heated volume, the fraction of the temperature rise that would have been reached in the heated volume in the absence of heat outflow. Note that where c=0.1 or c=0.2, the total percentage of heat lost to adjacent formations is relatively small, about 10% to 15%. Where low final temperatures, e.g., less than 100° C., are suitable, c up to 0.3 can be accepted, as the heat lost, or extra heat needed to maintain the final temperature, is, while significant, economically acceptable. FIG. 9, curve B, showing percent heat loss as a function of the factor c, shows percent heat loss to be less than 25% at c=0.3. On the other hand, if higher temperatures (e.g., about 200° C.) are desired to crack the bitumen, then higher central deposit temperatures above the design minimum are needed to process more of the deposit, especially if longer heating times are employed. Moreover, the heat outflows at these higher temperatures are more economically disadvantageous. Thus a temperature profile factor of c less than about 0.15 is required. In general the heating rate should be great enough that c is less than 30 times the inverse of the ultimate increase in temperature AT in degrees celsius of the volume:

$$c \leqq 0.3(100/\Delta T)$$

The lowest values of c are controlled more by the excess temperature of electrodes and are discussed below.

The electrode spacing distance d and diameter a are determined by the maximum allowable electrode temperature plus some excess if some local vaporization of the electrolyte and connate water can be tolerated. In a reasonably dense array, the hot regions around the electrodes are confined to the immediate vicinity of the electrodes. On the other hand, in a sparse array, where s is no greater than d, the excess heat zone comprises a major portion of the deposit.

FIG. 11 illustrates a grossly excessive heat build-up on the electrodes as compared to the center of the deposit for a sparse array. In this example row spacing s was 10 m, electrode spacing d 10 m, electrode diameter a 0.8 m, and thermal diffusivity $10^{-6}$ $m^2/s$, with no fluid flow.

FIG. 12 shows how the electrode temperature can be reduced by the use of a dense array. In this example row spacing s was 10 m, electrode spacing d 4 m, electrode diameter a 0.8 m, and thermal diffusivity $10^{-6}$ $m^2/s$, with no fluid flow.

FIG. 13 illustrates the effect of decreasing the diameter of the electrodes of the dense array of FIG. 12 such that the temperature of the electrode is increased somewhat more relative to the main deposit. In this example row spacing s was 10 m, electrode spacing d 4 m, electrode diameter a 0.35 m, and thermal diffusivity $10^{-6}$ $m^2/s$, with no fluid flow. The region of increased temperature is confined to the immediate vicinity of the electrode and does not constitute a major energy waste. Thus, varying the electrode separation distance d and the diameter of the electrode a permit controlling the temperature of the electrode either to prevent vaporization or excessive vaporization of the electrolyte in the borehole and connate water in the formations immediately adjacent the electrode.

The electrode spacing d and diameter a are chosen so that either electrode temperature is comparable to the vaporization temperature, or if some local vaporization is tolerable (as for a moderately dense array), the unmodified electrode temperature rise without vapor cooling will not significantly exceed the vaporization temperature.

The means for providing water for both vaporization and for maintenance of electrical conduction is shown in the drawings, particularly in FIG. 3 for vertical electrodes and in FIG. 4 for horizontal electrodes. As shown in FIG. 3, a reservoir 46 of aqueous electrolyte provides a conductive solution that may be pumped by a flow regulator and pump 47 down the shaft 22 and up the interior of the electrodes 12 and into the spaces between the electrodes 12 and the formation 26. A vapor relief pipe 48, together with a pressure regulator and pump 50 returns excess electrolyte to the reservoir 46 and assures that the electrolyte always covers the electrodes 12. Similarly, a reservoir 52 provides such electrolyte down the shaft 22, whence it is driven by a pressure regulator and pump 53 up the interior of the electrodes 14 and into the spaces between the electrodes 14 and the formation 26. In this case the electrodes are energized and not at ground potential. The conduits 54 carrying the electrolyte through the shaft 22 are therefore at the potential of the power supply and must be insulated from ground, as is the reservoir 52. The conduits 54 are therefore in the central conductor of the coaxial line 17. The electrodes 14 have corresponding vapor relief pipes 56 and a related pressure regulator and pump 58.

As shown in FIG. 4, electrolyte is provided as needed from reservoirs 60, 61 to the interior tubing 62 which also acts to connect the power source 38 to the respective electrodes 34, 36, the tubing being insulated from the overburden 28 and the deposit 26 by insulation 64. The electrolyte goes down the tubing 62 to keep the spaces between the respective electrodes 34, 36 and the deposit 26 full of conductive solution during heating. The tubing to the lower electrode 36 may later be used to pump out the oil entering the lower electrode, using a positive displacement pump 66.

In either system, the electrolyte acts as a heat sink to assure cool electrodes and maintain conductive paths between the respective electrodes and the deposit. The water in the electrolyte may boil and thereby absorb heat to cool the electrodes, as the water is replenished.

The vaporization temperature is controlled by the maximum sustainable pressure of the deposit. Typically for shallow to moderate depth deposits the gauge pressure can range from a few psig to 300 psig with a maximum of about 1300 psig for practical systems. The tightness of adjacent formations also influences the maximum sustainable vapor pressure. In some cases, injection of inert gases to assist in maintaining deposit pressure may be needed.

Another way to keep the electrodes cool is to position the electrodes adjacent a reduced field region on one side of an active electrode row. This reduces radically the heating rate in the region of the diminished field, thus creating in effect a heat sink which radically reduces the temperature of the electrodes, in the limiting case to about half the temperature rise of the center portion of the deposit.

As shown in FIGS. 7 and 8, in the case of vertical arrays, pairs of electrodes 12, 14 can be installed from the same drift and the same potential is applied to each pair, thus the regions 44 between the pairs become low field regions. By proper selection of heating rates and pair separation, it is possible to control the temperature of the electrode at slightly below that for the center of the deposit. The thickness of the cool wall region 44 can be sufficiently thin that the cool wall region can achieve about 90% of the maximum deposit temperature via thermal diffusion from the heated volume after the application of power has ended.

As shown in FIGS. 4, 5 and 6 in the case of a horizontally enlarged biplate, a nearly zero field region exists on the barren side of the row of grounded upper electrodes 34 and a nearly zero field region exists on the barren side of the row of energized electrodes 36. Such low field regions act as the regions 44 in the system shown in FIGS. 7 and 8.

The arrangement of FIGS. 4, 5 and 6 with the upper electrodes grounded is superior to other arrangements of horizontal electrodes in respect to safety. No matter how the biplate rows are energized and grounded (such as upper electrode energized and lower electrode grounded, vice versa or both symmetrically driven in respect to ground) leakage currents will flow near the surface 24 that may be small but significant in respect to safety and equipment protection. These currents will create field gradients which, although small, can be sufficient to develop hazardous potentials on surface or near-surface objects 68, such as pipelines, fences and other long metallic structures, or may destroy operation of above-ground electrical equipment. To mitigate such effects, ground mats can be employed near metallic structures to assure zero potential drops between any metallic structures likely to be touched by anyone.

These safety ground mats as well as electrical system grounds will collect the stray current from the biplate array. These grounds then serve in effect as additional ground electrodes of a line. Leakage currents between the grounding apparatus at the surface and the biplate array also heat the overburden, especially if the uppermost row is excited and the deposit is shallow. Thus biplate arrays, although having two sets of electrodes of large areal extent, also implicitly contain a third but smaller set of electrodes 68 near the surface at ground potential. Although this third set of electrodes collects diminished currents, the design considerations previously discussed to prevent vaporization of water in the earth adjacent the other electrodes must also be applied.

The near surface ground currents are minimized if the upper electrodes 34 are grounded and the lower electrodes 36 are energized. Also the grounded upper electrodes 34 can be extended in length and width to provide added shielding. This requires placing product collection apparatus at the potential of the energized lower set of electrodes by means of isolation insulation. However, this arrangement reduces leakage energy losses as compared to other electrodes energizing arrangements. Such leakage currents tend to heat the overburden 28 between the row of upper electrodes 34 and the above-ground system 68, giving rise to unnecessary heat losses.

Short heating times stress the equipment, and therefore, the longest heating times consistent with reasonable heat losses are desirable. This is especially true for the horizontal biplate array. The conductors of an array in the biplate configuration, especially if it is fairly long, will inject or collect considerable current. The amount of current at the feed point will be proportional to the product of the conductor length l, the distance d between electrodes within the row, and the current density J needed to heat the deposit to the required temperature in time t. Thus the current I per conductor becomes at the feed point (assuming small attenuation along the line):

$$I = (J)\,(l)\,(d)$$

Note that $J = \left[ (\text{joules-to-heat})\,\frac{\sigma}{t} \right]^{\frac{1}{2}}$ and $t = \frac{c(h/2)^2}{k}$ so that $I = \left[ \frac{(\text{joules-to-heat})\sigma k}{c(h/2)^2} \right]^{\frac{1}{2}} (l)\,(d)$ where $\sigma$ is the conductivity of the reservoir and joules-to-heat is the energy required to heat a cubic meter to the desired temperature. Thus the current carrying requirement of the conductors at the feed points is reduced by increasing the heat up time t as determined by the maximum allowable temperature profile factor c and deposit thickness h. Further, making the array more dense, that is, decreasing d, also reduces the current carrying requirements as well as decreasing l. If conductor current at the feed point is excessive, heat will be generated in the electrode due to $I^2R$ losses along the conductor. The power dissipated in the electrode due to $I^2R$ losses can significantly exceed the power dissipated in the reservoir immediately adjacent the electrode. This can cause excessive heating of the electrode in addition to the excess heat generated in the adjacent formation due to the concentration of current near the electrode. Thus another criterion is that the $I^2R$ conductor losses not be excessive compared to the power dissipated in the media due to narrowing of the current flow paths into the electrodes. Also the total collected current should not exceed the current carrying rating of the cable feed systems.

Another cause of excess temperature of the electrodes over that for the deposit arises from fringing fields near the sides of the row of excited electrodes. Here the outermost electrodes (in a direction transverse to the electrode axis) carry additional charges and currents associated with the fringing fields. As a consequence, both the adjacent reservoir dissipation and $I^2R$ longitudinal conductor losses will be significantly increased over those experienced for electrodes more centrally located. To control the temperature of these outermost electrodes, several methods can be used, including: (1) increasing the density of the array in the outermost regions, (2) relying on additional vaporization to cool these electrodes, and (3) the enlarging the diameter of these electrodes. Some cooling benefit will also exist for the cool-wall approach, especially in the case of the vertical electrode arrays if an additional portion of the deposit can be included in the reduced field region near the outermost electrodes. Applying progressively smaller potentials as the outermost electrodes are neared is another option.

In the case of the biplate array, especially if it extends a great length into the deposit, such as over 100 m, special attention must be given to the path losses along the line. To alleviate the effects of such attenuation, the line may be fed from both ends, as shown in FIG. 6. At the higher frequencies, these are frequency dependent and are reduced as the frequency is decreased. Perhaps not appreciated in earlier work, is that there is a limit to how much the path attenuation can be reduced by lowering the frequency. The problem is aggravated because, as the deposit is heated, it becomes more conducting.

A buried biplate array or triplate array exhibits a path loss attenuation $\alpha$ of $$\alpha=8.7[(R+j\omega L)(G+j\omega C)]^{\frac{1}{2}}dB/m$$

where

R is the series resistance per meter of the buried line, which includes an added resistance contribution from skin effects in the conductor, if present, L is the series inductance per meter of the buried line, G is the shunt conductance over a meter for the line and is directly proportional to $\sigma$, the conductivity of the deposit, C is the shunt capacitance over a meter for the line. Where conduction currents dominate, $G>>j\omega c$, so that the attenuation $\alpha$ becomes $$\alpha=8.7[(R+j\omega L)(G)]^{\frac{1}{2}}dB/m$$

If the frequency $\omega$ is reduced, $j\omega L$ is radically reduced, R is partially decreased (owing to a reduction in skin effect loss contribution) and G tends to remain more or less constant. Eventually, as frequency $\omega$ is decreased, $R>>j\omega L$, usually at a near zero frequency condition, so that $$\alpha=8.7[(R)(G)]^{\frac{1}{2}}dB/m$$

If thin wall steel is used as the electrode material, unacceptable attenuation over fairly long path lengths could occur, especially at the higher temperatures where conductance G and conductivity $\sigma$ are greater. If thin walled copper or aluminum is used for electrodes (these may be clad with steel to resist corrosion), the near zero-frequency attenuation can be acceptably reduced so that $$\alpha l=8.7[(R)(G)]^{\frac{1}{2}}(l)\leqq 2dB$$

for the single end feed of FIG. 4 and less than 8 dB for the double end feed of FIG. 6.

When d.c. power is applied, advantage may be taken of electro-osmosis to promote the production of liquid hydrocarbons. In the case of electro-osmosis, water and accompanying oil drops are usually attracted to the negative electrodes. The factors affecting electro-osmosis are determined in part by the zeta potentials of the formation rock, and in some limited cases the zeta potentials may be such that water and oil are attracted to the positive potential electrodes.

Electro-osmosis can also be used to cause slow migration of the reservoir water toward one of the sets of electrodes preferentially. This preferential migration will be toward the cathode for typical reservoirs. However, depending upon the salinity of the reservoir fluids and the mineralogy of the reservoir matrix, the net movement under application of d.c. can be toward the anode. Remote ground can be used as an opposing electrode to facilitate this. This can be used to replenish conductivity in formations around the desired electrodes of sets of electrodes by resaturating the formation using reservoir fluids. This will permit resumption of heating.

In some cases, the presence of water fills the available pore spaces and thereby suppresses the flow of oil. Also in the case of a heavy oil deposit, influx of water from the lower reaches of the deposit may reach the producing electrodes such as electrodes 36 (FIG. 6). Therefore, in some cases it may be desirable to place a potential onto both sets of electrodes 34, 36 such that water is drawn away from the array. This may be done by modifying the source 38 such that the ground electrode array 68 near the surface is placed at a negative potential with respect to the entire set of deep electrodes 34, 36.

D.C. power applied for electro-osmosis can cause anodic dissolution of the metal electrodes, and hence, it will be preferable to keep the d.c. power levels just high enough to cause migration of fluids. Such required d.c. power can either be added as a bias to a.c. power which provides the bulk of the energy required to heat the formation or be applied intermittently.

While the use of electro-osmotic effects to enhance recovery from single wells or pairs of wells has been described, the employment of the dense array offers unique features heretofore unrecognized. For example, in the case of a pair of electrodes widely separated, the direct current emerges radially or spherically from the electrode. The radially divergent current produces a radially divergent electric field, and since the electro-osmotic effect is proportional to the electric field, the beneficial effects of electro-osmosis are evident only very near the electrode. Furthermore, the amount of current which can be introduced by an electrode is restricted by vaporization consideration or, if the deposit is pressurized, by a high temperature coking condition which may plug the producing capillary paths. On the other hand, with the arrangement of the present invention, the large electrode surface area and the controlled temperature below the vaporization point allows substantially more d.c. current to be introduced. Further, the effects of electro-osmosis are felt throughout the deposit, as uniform current flow and electric fields are established throughout the bulk of the deposit. Thus an electro-osmotic fluid drive phenomenon of substantial magnitude can be established throughout the deposit which can substantially enhance the production rates.

Further, electrolyte fluids will be drawn out of the electrodes which are not used to collect the water. Therefore, means to replace this electrolyte must be provided.

Production of liquid hydrocarbons using electro-osmosis can also be practiced in combination with conventional recovery techniques such as gravity drainage. Electro-osmosis can be used to increase the rate of production of liquid hydrocarbons by gravity drainage. For example, the polarity of the electrode rows shown in FIG. 5 can be so chosen such that reservoir water will slowly move toward the upper row of electrodes 34. This will cause a simultaneous increase in saturation of hydrocarbons toward the bottom row of electrodes 36. The rate of flow of hydrocarbons toward these bottom electrodes 36 is directly proportional to the permeability of the formation near the electrodes to flow of hydrocarbons. This in turn increases with increase in hydrocarbon saturation. Thus, the rate of hydrocarbon production can be increased by forcing the reservoir water to move toward the upper part of the formation by electro-osmosis.

Although various preferred embodiments of the present invention have been described in some detail, various modifications may be made therein within the scope of the invention.

Several methods of production are possible beyond the unique features of electro-osmosis. Typically, the oil can be recovered via gravity or autogenously generated vapor drives into the perforated electrodes, which can serve as product collection paths. Provision for this type of product collection is illustrated in FIG. 4, where a positive displacement pump 66 located in the lowest level of electrode 36 can be used to recover the product. Product can be collected in some cases during the heat-up period. For example, in FIG. 4 the reservoir fluids will tend to collect in the lower electrode array. If those are produced during heating, those fluids can provide an additional or substitute means to control the temperature of the lower electrode. On the other hand, it may not be desirable to produce a deposit, if in situ cracking is planned, until the final temperature is reached.

Various "hybrid" production combinations may be considered to produce the deposit after heating. These could include fire-floods, steam floods and surfactant-/polymer water floods. In these cases, one row of electrodes can be used for fluid injections and the adjacent row for fluid/product recovery.

In contrast with polarizing the electrodes so as to suppress the production of water, the electro-osmotic forces can be used as a drive mechanism which exists volumetrically throughout the deposit for a fluid replacement type flood. The principal benefits of using the electro-osmotic drive in conjunction with the electrode arrays discussed here is that the volumetric drive can be maintained without excessive heat being developed near the electrode or without excessive electrolysis as might occur in a simple five-spot well arrangement.

The fluids injected at the electrodes can contain surfactants such as long chain sulfonates or amines or polymers such as polyacrylamides. The presence of surfactants will reduce the interfacial tension between the injected fluids and the liquid hydrocarbons and will help in recovering the liquid hydrocarbons. Addition of polymers will increase the viscosity and cause an improvement in sweep efficiency. The applied d.c. power can act as the driving force for the migration of fluids toward the other set of eIectrodes, whereby the accompanying liquid hydrocarbons can be produced along with the drive fluid.

The foregoing discussion, for simplicity, has limited consideration to either vertical or horizontal electrode arrays. However, arrays employed at an angle with respect to the deposit may be useful to minimize the number of drifts and the number of boreholes. In this case, the maximum row separation s is chosen to be midway between the vertical or horizontal situation, such that if largely vertical, the row separation s is not much greater than that found for the true vertical case. On the other hand, if the rows are nearly horizontal, then a value of s closer to that chosen for a horizontal array should be used.

What is claimed is:

1. An electro-osmotic method for the production of hydrocarbons utilizing in situ heating of earth formations having substantial electrical conductivity occasioned by the presence of water, said method comprising bounding a particular volume of a said earth formation with a waveguide structure formed of respective rows of discrete elongated electrodes in a dense array with the spacing between rows greater than the distance between electrodes in a row wherein the active electrode area and the row separation are chosen in reference to the formation thickness to avoid heating barren layers, the row separation being no greater than about the thickness of said formation, applying electrical power at no more than a relatively low frequency between respective said rows of electrodes to deliver power to said bounded volume of said formation while producing relatively uniform heating thereof and limiting the relative loss of heat to adjacent regions, and utilizing a d.c. polarized potential to make the electrodes of one row anodic and the electrodes of another row cathodic and thereby enhance the flow of reservoir fluid toward at least one preselected electrode, at the same time controlling the temperature of said electrodes thereat to retain water and thereby maintain an electrically conductive path between said electrodes and said formation, and removing collected reservoir fluids that have flowed between said rows toward said at least one preselected electrode.

2. A method according to claim 1 wherein said temperature of said electrodes is controlled by providing a heat sink adjacent said electrodes.

3. A method according to claim 2 wherein said temperature of said electrodes is controlled by conducting heat from said electrodes to a cooler region outside said bounded volume.

4. A method according to claim 2 wherein said heat sink is provided by supplying aqueous liquid electrolyte to space between said electrodes and the adjacent said formation, thereby maintaining the temperature thereat no greater than about the boiling point of water and maintaining a conductive path between said electrodes and said formation.

5. A method according to claim 1 wherein a region of reduced electric field intensity is created adjacent said rows of electrodes outside said bounded volume.

6. An electro-osmotic method for the production of hydrocarbons utilizing in situ heating of earth formations having substantial electrical conductivity occasioned by the presence of water, said method comprising bounding a particular volume of a said earth formation with a waveguide structure formed of respective rows of discrete elongated electrodes in a dense array with the spacing between rows greater than the distance between electrodes in a row wherein the active electrode area and the row separation are chosen in reference to the formation thickness to avoid heating barren layers, the row separation being no greater than about the thickness of said formation, applying electrical power at no more than a relatively low frequency between respective said rows of electrodes to deliver power to said bounded volume of said formation while producing relatively uniform heating thereof and limiting the relative loss of heat to adjacent regions, and utilizing a d.c. polarized potential to make the electrodes of one row anodic with the use of a remote ground for cathodic contact and thereby enhance the flow of reservoir fluid toward at least one preselected electrode, at the same time controlling the temperature of said electrodes thereat to retain water and thereby maintain an electrically conductive path between said electrodes and said formation, and removing collected reservoir fluids that have flowed between said rows toward said at least one preselected electrode.

7. A method according to claim 1 further including injecting electrolyte into said formation adjacent the electrodes in the row other than the row containing said at least one preselected electrode to maintain conduction and replace fluids that have migrated to a product collection electrode.

8. A method according to any one of claims 2, 3, 4, 5 and 6 further including injecting electrolyte into said formation adjacent the electrodes in the row other than the row containing said at least one preselected electrode to maintain conduction and replace fluids that have migrated to a product collection electrode.

9. A method according to any one of claims 1, 2, 3, 4, 5, 6 and 7 wherein the applied d.c. potential is used to provide substantially all of the energy required to heat the formation to increase the mobility of the hydrocarbons.

10. A method according to any one of claims 1, 2, 3, 4, 5 and 7 wherein the applied d.c. potential is used both for heating of the formation and for providing an electro-osmotic drive for the recovery of the fluids.

11. A method according to any one of claims 1, 2, 3, 4, 5, 6 and 7 wherein a.c. power is applied to provide primary heating of the formation and d.c. potential is utilized as a superimposed bias for providing electro-osmotic drive.

12. A method according to any one of claims 1, 2, 3, 4, 5, 6 and 7 wherein said electrodes are disposed substantially horizontally in rows spaced substantially vertically from one another, with the electrodes nearer the top of the formation being at a more positive d.c. potential than the lower electrodes to assist gravity drainage.

13. A method according to any one of claims 1, 2, 3, 4, 5, 6 and 7 wherein fluids are added to the anodic row to replace fluids produced by electro-osmosis.

14. A method according to any one of claims 1, 2, 3, 4, 5, 6 and 7 wherein fluids containing surfactants are added at respective electrodes.

15. A method according to any one of claims 1, 2, 3, 4, 5, 6 and 7 wherein fluids containing polymers are added at respective electrodes.

* * * * *

UNITED STATES PATENT AND TRADEMARK OFFICE

CERTIFICATE OF CORRECTION

PATENT NO. : 4,645,004

DATED : February 24, 1987

INVENTOR(S) : Jack E. Bridges

It is certified that error appears in the above-identified patent and that said Letters Patent is hereby corrected as shown below:

Column 1, after the first paragraph insert the following paragraph: --The Government of the United States of America has rights in this invention pursuant to Contract No. DE-AC01-79ER10181 awarded by the U.S. Department of Energy.--

Signed and Sealed this

Twenty-eighth Day of November 1989

*Attest:*

JEFFREY M. SAMUELS

*Attesting Officer* *Acting Commissioner of Patents and Trademarks*